United States Patent [19]

Smith et al.

[11] Patent Number: 4,763,880

[45] Date of Patent: Aug. 16, 1988

[54] ROTARY HEARTH MULTI-CHAMBER, MULTI-PURPOSE FURNACE SYSTEM

[75] Inventors: John W. Smith, Northville, Mich.; Gary D. Keil, Elmwood, Ill.

[73] Assignee: Holcroft/Loftus Inc., Livonia, Mich.

[21] Appl. No.: 33,971

[22] Filed: Apr. 3, 1987

[51] Int. Cl.[4] ..... C21D 9/00

[52] U.S. Cl. ..... 266/87; 266/252; 266/259

[58] Field of Search ..... 266/87, 90, 251, 252, 266/259, 287, 130–133; 932/138, 207, 208

[56] References Cited

U.S. PATENT DOCUMENTS

| | | | |
|---|---|---|---|
| 1,783,156 | 4/1930 | Talley | 432/34 |
| 2,013,905 | 10/1935 | Adams, Jr. | 263/7 |
| 2,978,237 | 5/1961 | Frank | 263/6 |
| 3,197,184 | 7/1965 | Narez et al. | 263/7 |
| 3,598,381 | 8/1971 | Schwalm et al. | 266/97 |
| 3,662,996 | 5/1972 | Schwalm et al. | 266/130 |
| 3,819,323 | 6/1974 | Hemsath | 432/138 |
| 3,998,703 | 7/1976 | Harrell | 201/32 |
| 4,093,195 | 1/1978 | Schwalm | 266/251 |
| 4,412,813 | 6/1983 | Wulf | 432/11 |
| 4,662,006 | 5/1986 | Hohne | 432/11 |

FOREIGN PATENT DOCUMENTS 3506131 5/1986 Fed. Rep. of Germany .

OTHER PUBLICATIONS

*Metal Progress*, Sep. 1985, pp. 19–20.

*Primary Examiner*—Christopher W. Brody
*Attorney, Agent, or Firm*—Herbert E. Messenger

[57] ABSTRACT

A continuous carburizing furnace system is disclosed having at least two series-connected rotary furnaces. The rotary carburizing furnace, a rotary equalizing furnace, and a rotary diffusion furnace which may be included between the carburizing and equalizing furnaces, allow trays of parts to be discharged from any position at any time by suitable rotation of their hearths, thus allowing parts with different cycle times to be run simultaneously in each rotary furnace. Each donut-shaped rotary furnace includes one or more captive chain type pusher mechanisms mounted in vertical fashion within a central area or hole, and the rotary carburizing furnace is multi-zoned and includes wall-mounted fans for uniform circumferential control of the gaseous atmosphere within its annular chambers. Two different quenching apparatuses and a slow cool assembly adjacent multiple outlets of the equalizing furnace permit the use of different cooling/quenching processes on selected parts, and parts may also be returned from the slow cool assembly to the equalizing furnace for reheating.

16 Claims, 6 Drawing Sheets

ROTARY HEARTH MULTI-CHAMBER, MULTI-PURPOSE FURNACE SYSTEM

BACKGROUND OF THE INVENTION

This invention relates to continuous multi-furnace heat treating systems and particularly to a furnace system wherein multiple rotary furnaces are employed to simultaneously process, in a single system, parts requiring different heat treatment cycles.

Existing continuous carburizing furnace systems frequently include different sections or chambers for separating the various treatments employed in the carburizing processes—namely, heating, carburizing, diffusion, and equalize cooling. For example, U.S. Pat. Nos. 3,598,381 and 3,662,996 describe apparatus having separate furnace stages, generally rectangular in plan view, for heating, carburization, and diffusion of metal parts at selected temperatures and in different gaseous atmospheres for specified periods of time. In such systems trays of parts are pushed or pulled one after another through each furnace in a fixed sequence, with each tray remaining in the same relative position in its line throughout its passage through the system. Each part receives an identical heat treatment.

Although the above-mentioned systems have been widely used for continuous, lengthy runs of similar parts, they are not well-suited for plants in which it is necessary to process a variety of metal parts which require different cycle times and/or different types of quenching/cooling, and where it is desired to "manufacture-on-demand" a variety of parts so as to maintain low inventories. For example, the systems of U.S. Pat. Nos. 3,598,381 and 3,662,996 would be cumbersome to utilize for such applications because they generally can achieve different heat treatments only by partial or complete unloading of a line through the use of empty trays in selected portions of a processing line. Such approaches are time-consuming and substantially reduce efficiency of a furnace system.

Limited attempts have been made to provide greater flexibility of processing parts in furnace systems by the use of a single rotary hearth carburizing furnace, as disclosed at pages 19 and 21 of *Metal Progress* (September 1985). Also, FIG. 6 of U.S. Pat. No. 3,598,381 shows a rotary hearth diffuser providing a diffusion chamber separate from a conventional carburizing chamber. While these systems offer some improvement, they allow part processing times to be varied only in a single portion of the total heat-treating process. Moreover, the rotary hearth furnaces disclosed in these prior art systems do not permit adequate zoning of their rotary furnace chambers into multiple zones or chambers for improved temperature control. Also, such single chamber rotary furnaces would require hot pulling mechanisms for the transfer of trays of parts between two rotary furnaces, decreasing the reliability of transfer and reducing accessability of the transfer mechanisms for maintenance.

Accordingly, it is an object of the invention to provide an improved furnace system wherein various parts are heat-treated for different periods of time while being processed through the system in adjacent trays and without requiring the use of specified numbers of empty trays in the system.

It is an object of the invention to provide a furnace system which simultaneously runs parts having variable heat-treating cycle times while maintaining the highest level of efficiency.

It is an object of the invention to provide a furnace system with multiple, interconnected chambers several of which simultaneously heat treat parts with different processing time requirements.

It is an object of the invention to provide a furnace system which, in addition to the above, moves parts between chambers solely by pushing action and without intermixing of the atmospheres of interconnected chambers.

It is an object of the invention to provide a multi-chamber furnace system wherein in each of several chambers a tray of parts, regardless of its position, may be selected as the next tray to be discharged from that chamber.

It is an object of the invention to provide a furnace system with a rotary-hearth carburizing furnace having multiple temperature-controlled zone and improved circulation of its gaseous atmosphere.

It is an object of the invention to provide a furnace system with multiple rotary chambers having improved uniformity of temperature and atmosphere within each chamber.

It is an object of the invention to provide a multi-chamber furnace system wherein any tray of parts within a rotary equalizing chamber may, regardless of position within the chamber, be directed to a selected discharge door for quenching/cooling in one of multiple apparatuses of different types.

It is an object of the invention to provide a furnace system with multiple rotary furnaces including an equalizing furnace which is operable to cool parts, to transport parts to a slow cool apparatus and/or to selected quench devices, and to reheat parts returned from the slow cool apparatus.

SUMMARY OF THE INVENTION

The invention is a continuous carburizing furnace system with multiple rotary furnaces arranged in series, and with each rotary furnace adapted to heat treat trays of different parts for varying durations of time and then to push a selected tray into the next furnace or processing chamber for further treatment. The system simultaneously processes a mix of parts requiring different cycle times, thereby providing different case depths and diffused depths on parts, as desired, and while maintaining high furnace efficiencies and uniform furnace atmospheres.

In a preferred form, the furnace system of the invention comprises three "donut"-shaped furnaces—a carburizer, a diffuser, and an equalizer—each having a circular rotatable hearth for supporting and moving trays of parts within an annular furnace chamber. Each rotary furnace is connected to another rotary furnace by a patented double door arrangement which prevents intermixing of gaseous atmospheres of the adjacent furnace chambers. One or more pushers is included within the circular space or "hole" of each donut-shaped furnace for discharging trays of parts. The rotary hearths permit discharge of any tray from any position within a furnace at any time by rotation of the selected position on the hearth to the discharge door of the furnace, thus providing high degree of flexibility in operation of the system.

The equalizer furnace of the above-referenced preferrred system serves as a cooling chamber, a mechanism for transporting trays of parts to a selected quench system or to a slow cool chamber, and as a reheat chamber for parts returned from the slow cool chamber. Trays that have been pushed into the slow cool chamber from the equalizing chamber can, after cooling, be re-introduced into the equalizing chamber for reheating and quenching or can be removed directly from the slow cool chamber to a tray return transfer line.

For maintaining uniform atmospheres within the carburizing chamber, special fans are mounted in its sidewalls. The fans, typically one per zone, provide circumferential circulation of gases in the furnace chamber of the carburizer in a direction counter to the rotation of its hearth. Uniformity of the atmosphere is also ensured by monitoring and controlling temperatures within the multiple zones. In the diffusion and equalizing chambers, roof fans may be employed for atmosphere uniformity, typically one per zone of the multiple zones.

DETAILED DESCRIPTION OF PREFERRED EMBODIMENTS

Figure 1:
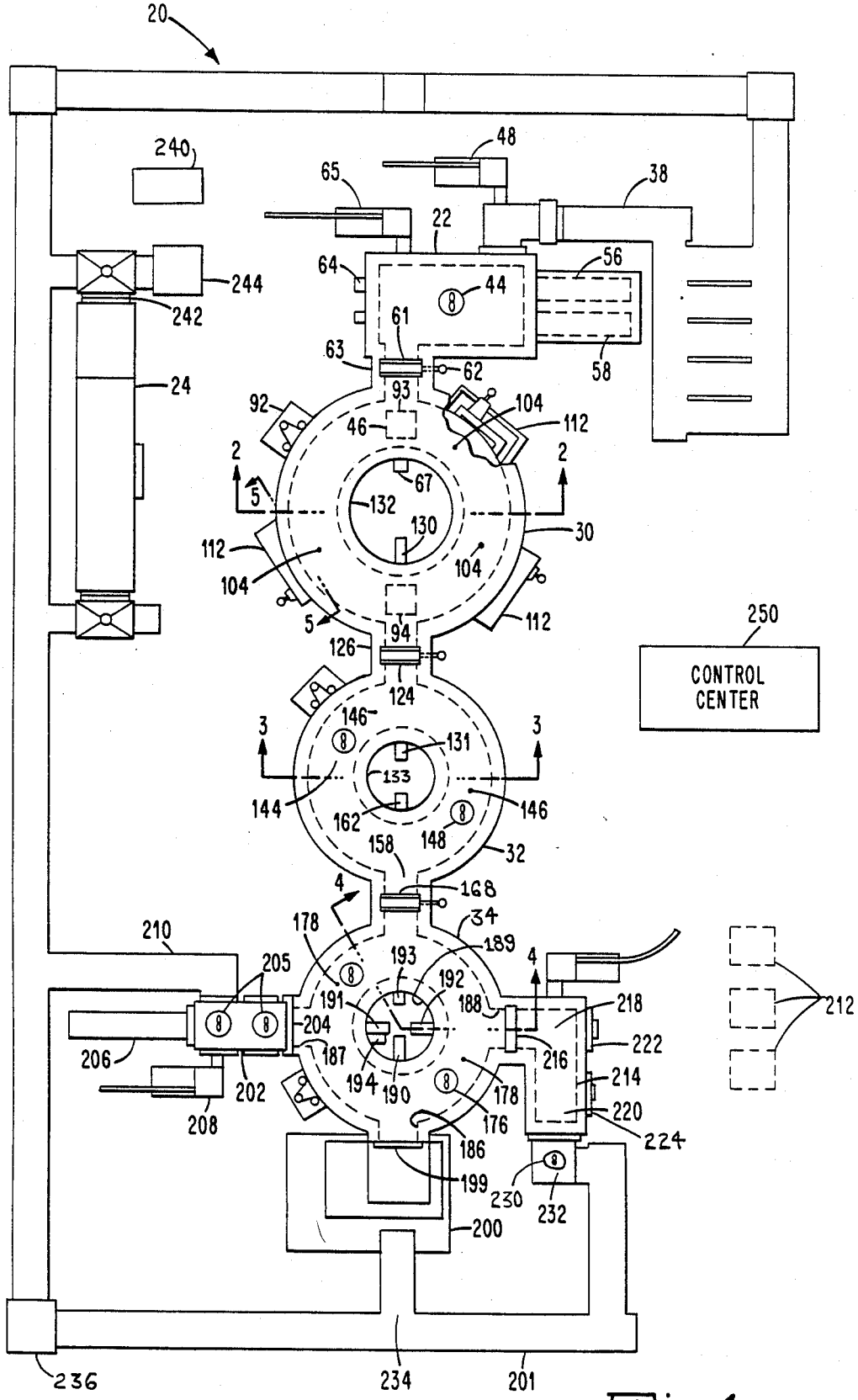
FIG. 1 is a diagrammatic plan view of a preferred furnace system according t the invention.

FIG. 1 illustrates the general layout or plan of a preferred continuous carburizing furnace system 20 according to the invention. (As used herein the term "carburizing" is intended to include processing not only in carbon-rich gas atmospheres but also in carbon/nitrogen (carbonitriding) atmospheres). The system 20 includes several interconnected furnaces each forming a separate furnace chamber in which trays loaded with parts are processed during a carburizing cycle. Some of the furnaces such as the preheat furnace 22 and the tempering furnace 24 typically are conventional units through which parts (trays of parts) are transported in the order in which they enter (The preheat furnace 22 may, as set forth hereinafter, achieve some flexibility of processing order through the use of dual rows with each row capable of being pushed at a different rate, or may be of the rotary "donut" type if desired). Others, such as the three series-connected rotary, donut-shaped furnaces 30, 32, and 34, are unique, variable-cycle furnaces which permit parts to be discharged in any selected order independent of the time and sequence of input. These furnaces and other components of the continuous carburizing system 20 will now be described in the order in which parts are processed during a carburizing cycle.

Figure 7:
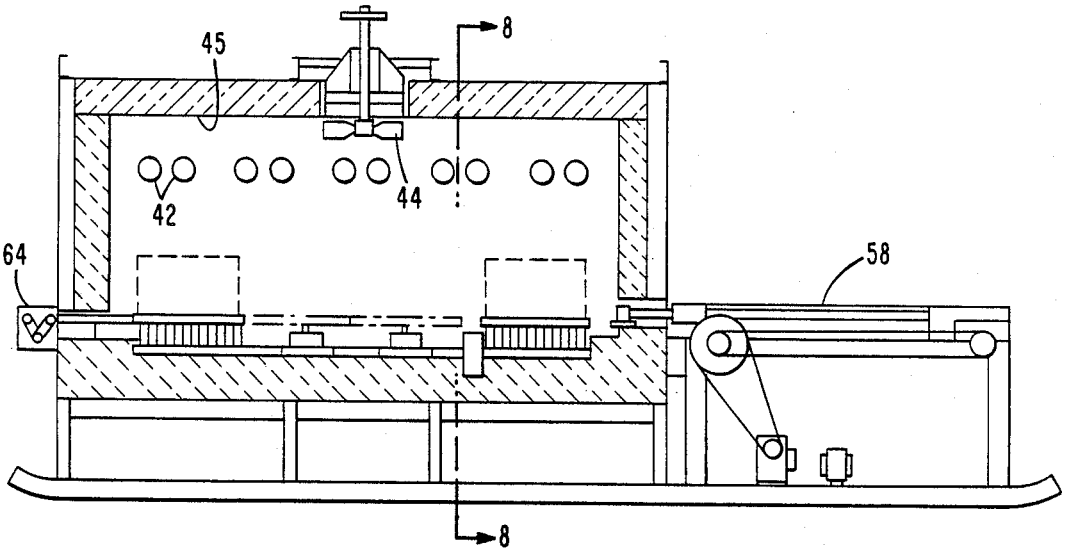
FIG. 7 is a longitudinal sectional view of the preheat furnace of a preferred furnace system.
Figure 8:
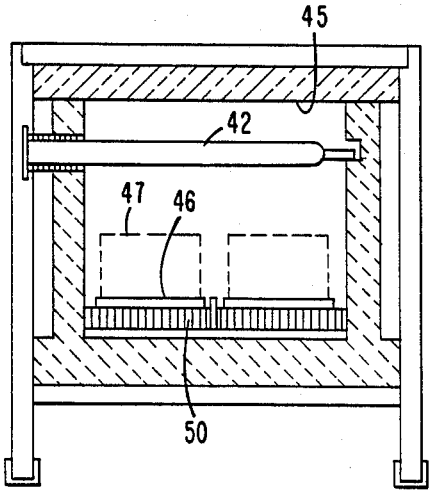
FIG. 8 is an end sectional view of the preheat furnace.

Trays loaded with parts to be carburized, e.g., gears, shafts, and other steel parts whose surface it is desired to harden, are first moved from a load/unload area 38 to a preheat furnace 22 (see FIGS. 1, 7 and 8). The preheat furnace 22, which is illustrated as a conventional, stationary hearth furnace but which may, if desired, comprise a rotary hearth furnace similar to those described hereinafter, functions to heat the work to the desired carburizing temperature such as about 1700° F. in a gaseous atmosphere which prevents decarburization or scaling. For this purpose radiant tubes 42, typically U-shaped tubes connected at one end to a gas-fueled or liquid-fueled burner (electrically heated radiant tubes may also be used), extend between sidewalls of the preheat furnace 22 above and, if necessary, also below the trays, and the gas atmosphere of the furnace 22 is controlled to contain a small amount of carbon (e.g., 0.2 percent by weight) by use of the output of an endothermic gas generator (not shown) plus nitrogen and, if required, a small amount of carbon enriching gas from a suitable supply. Recuperators of conventional design may be connected to the radiant tubes 42 to recover heat from the hot gases which have passed through the radiant tubes. One or more fans, such as the fan 44 mounted in the roof 45 of the furnace 22, may be provided to circulate gases so as to maintain a uniform atmosphere. Trays 46 of parts 47 are input to the preheat furnace 22 by action of a motor-driven pusher 48, typically a captive chain push-across well known in the furnace arts, then are pushed through the furnace 22 along rails 50 in a single line by a motor driven, rigid-type main pusher 56 or in a double line by two separate main pushers 56 and 58. The pushers 56 and 58 preferably are constructed to push trays to each tray position along the length of the preheat furnace 22, if necessary, so that this furnace can be emptied on shutdown without the use of empty trays. A preheat furnace having two adjacent lines each aligned with a separate main pusher and each having three or four tray positions may be desirable since this provides a large preheat capacity for quickly filling the adjacent carburizing furnace 30 during initial startup. A double line also allows some flexibility with respect to the time different parts remain in the preheat furnace. For example, it permits liqhter parts to be passed through the furnace 22 and into the carburizing furnace 30 more quickly than heavier parts which require longer preheat times. During normal operation not all preheat positions of the furnace 22 typically need be used to keep up with the carburizing furnace 30.

Figure 2:
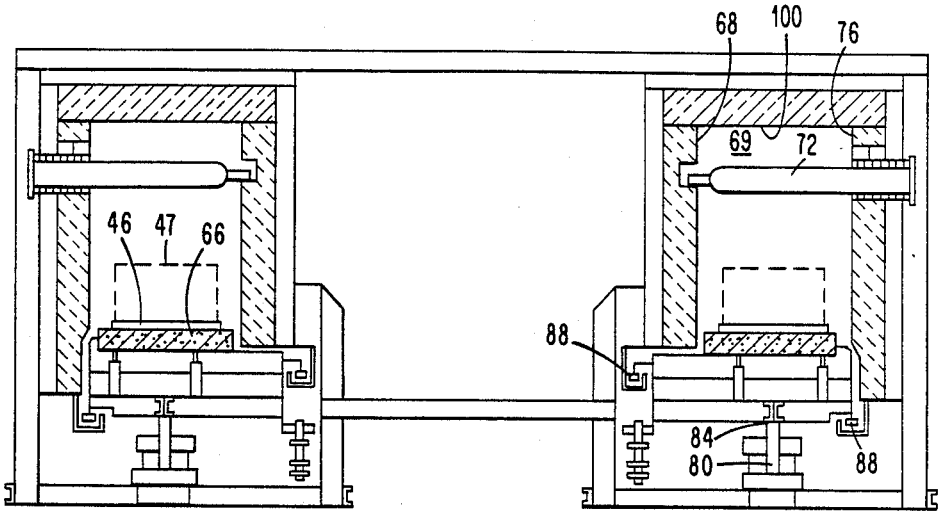
FIG. 2 is an elevational view in section of the rotary carburizing furnace taken along the line 2—2 of FIG. 1.

The exit end of the preheat furnace 22 is connected to a rotary caburizing furnace 30 and separated from it by a special double-door structure 61, whose doors are normally closed. A suitable double-door structure 61 is that described in U.S. Pat. No. 3,662,996 and illustrated in FIG. 2 thereof. The disclosure of U.S. Pat. No. 3,662,996 is incorporated herein by this reference to it. Such door structures include an effluent structure 62 in one of the sidewalls in a connecting zone 63 extending between the two doors 61. The effluent structure 62 serves as an outlet for venting gases flowing into the connecting zone 63 from either the preheat furnace 22 or the carburizing furnace 30 when the doors 61 are closed and, more importantly, when they are open. Thus intermixing of the different atmospheres of the furnaces 22 and 30 is prevented.

To insure that trays of parts to be input to the carburizing furnace 30 attain the proper location in the preheat furnace 22 for transfer, trays advancing along each line of the preheat furnace 22 interact with a tray positioner 64 provided at the exit end of the preheat furnace 22. Each tray positioner 64 includes a positioning bar which extends into the furnace 22 and is contacted by a tray before the tray reaches the "discharge position" of the preheat furnace 22. The advancing tray pushes the positioning bar back along the direction of tray movement until the tray reaches the discharge position, at which point the tray positioning bar trips a switch, halting pushing action of the main pusher 56, and causing retraction of the tray positioning bar.

When it is desired to move a tray 46 into the rotary carburizer 30, the doors 61 are raised. The tray is then pushed by action of a motor-driven pusher 65, typically a captive chain push-across, onto a circular hearth 66 within the carburizer 30. Proper positioning of the tray on the hearth 66 is assured by interaction between the pusher 65 and a tray positioner 67 similar to the above-described positioner 64 and located within the central "donut" hole formed by the inner sidewall 68 of the carburizing furnace 30.

A controlled carbon-enriched gaseous atmosphere is provided in the annular furnace chamber 69 formed by the donut-shaped carburizing furnace 30 so that carbon uniformly penetrates into the surface of the parts. The atmosphere may be provided by an endothermic gas generator with carbon enrichment linked to an atmosphere analyzer/controller which may include oxygen probes. A typical carbon content for the atmosphere may, for example, be a value in the range of about 1–1.35 percent by weight. To maintain the desired elevated temperature (e.g. 1700° F.) for oarburizing, radiant tubes 72 (FIG. 2) extend between inner and outer sidewalls 68 and 76, and the sidewalls 68 and 76 are preferably formed of, or lined with, insulating refractory material.

Parts are moved within the carburizer 30 by rotation of the hearth 66 within the annular carburizing chamber 69, and the hearth 66 is typically rotated continuously except when stopped to receive or discharge parts. To facilitate movement, the hearth 66 is supported on stationary wheels 80 which run on a circular track 84 on the underside of the hearth 66. Suitable oil seals 88 are provided adjacent to the hearth on the inner and outer diameter to prevent leaking of its gaseous atmosphere around the hearth, and the oil preferably is circulated to and from an air/oil heat exchanger (not shown) to maintain oil temperatures at a preselected level. Rotation of the hearth 66 is accomplished by action of a drive mechanism 92 such as a hydraulic motor-driven chain. The drive mechanism includes speed controls to adjust hearth movement for acceleration, normal running speed, and deceleration, and preferably rotates the hearth 66 in just one direction during normal production operations. If configured for hearth movement in just a single direction during production, the drive mechanism 92 preferably allows manual "jog" reversal of the hearth rotation in the event of a malfunction and to allow maintenance to be performed. Alternatively, the mechanism 92 may be arranged to rotate the hearth 66 in both clockwise and counterclockwise directions during production, with direction of rotation automatically selected to minimize the required travel of the hearth for discharge of a selected tray from the carburizing chamber 69. Normal rotational speed of the hearth 66 is preferably at least one revolution per minute, however, and at such speeds so the "minimum travel" benefit of dual rotation is likely not worth the additional complexity required to provide and control it.

In the furnace system 20 trays of parts are transported from their entry position 93 adjacent to the double-door 61 of the carburizing furnace 30 to their discharge position 94 adjacent to the outlet door structure 96 by movement of the hearth 66 rather than by being pushed as part of a line of trays extending along a furnace chamber. Because any point on the hearth may be rotated to the discharge position 94, any tray of parts may be brought to the discharge position at any time regardless of how long it has remained in the carburizing furnace 30. This permits a mix of parts, some of which require longer carburizing times than others—for example, to achieve greater case depths—to be carburized simultaneously in the furnace 30. It also allows parts whose heat treatment is needed on a high priority basis to be preferentially discharged ahead of parts which can tolerate additional carburization and are not needed immediately. Moreover, this multi-purpose operation of the carburizing furnace 30 is achieved without the use of a specified number of empty trays between trays of parts requiring different carburizing times. The use of a number of empty trays is a standard, inefficient method of changing cycle times in a conventional multi-chamber pusher furnace.

Proper carburization of parts in the furnace 30 requires that the gaseous atmosphere be uniform throughout the annular furnace chamber 69. Accordingly, the carburizing furnace chamber 69 is divided into multiple zones—for example, three zones in the preferred arrangement shown in FIG. 1. Temperature sensors 104 in each of the three zones monitor and control temperature of the gaseous atmosphere and the furnace chamber 69. The sensors 104 may, for example, be located near the center of each zone and sufficiently above the hearth 66 to not interfere with movement of loaded trays (e.g., about two inches above the loaded trays), and are linked through temperature controllers (not shown) to burners powering the radiant tubes 72 of their associated zone so as to maintain the desired chamber temperature. Because each zone is individually monitored and controlled, circumferential temperature variation is minimized, assuring proper carburization of parts.

Figure 5:
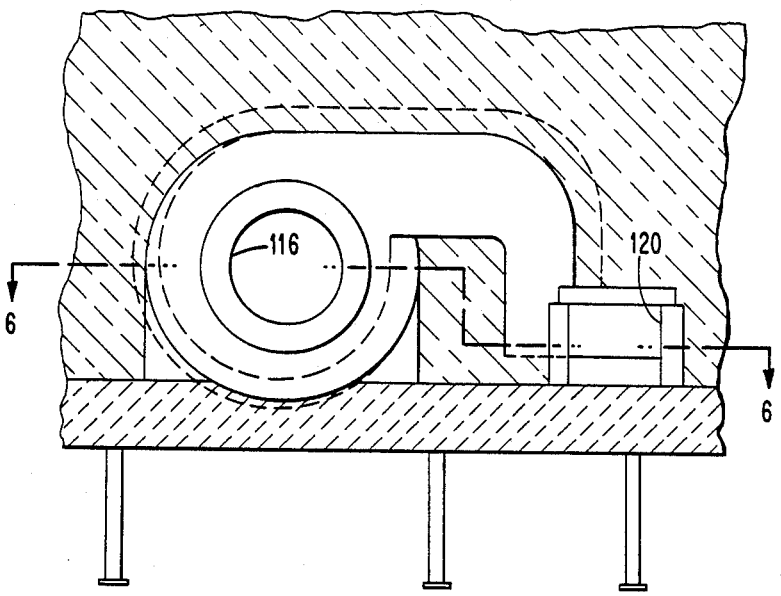
FIG. 5 is an elevational view of a portion of the rotary carburizing furnace taken along the line 5—5 of FIG. 1.
Figure 6:
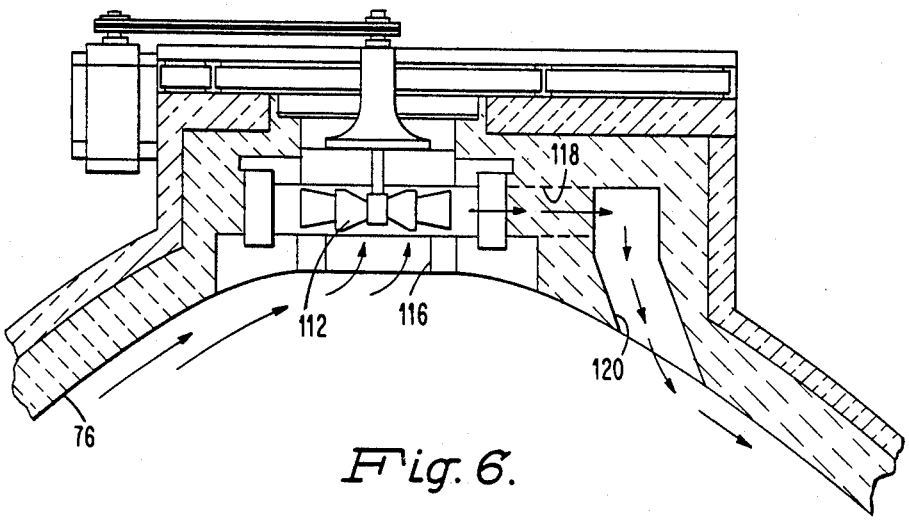
FIG. 6 is a top sectional view taken along the line 6—6 of FIG. 5 and illustrating a preferred wall-type atmosphere circulating fan.

Uniformity of the gaseous atmosphere is also promoted by fans 112 (FIGS. 1, 5, and 6), preferably scroll-type fans, mounted in the outer sidewall 76 above the hearth 66 of the rotary carburizer 30. Each fan is located within an inlet 116 of a tunnel 118 formed in the refractory of the sidewall 76 and directs flow to an outlet 120 circumferentially spaced along the sidewall 76, e.g., a distance of about four feet from the inlet 116. As is shown in FIG. 6, the outlets 120 may be angled to help produce a circumferential component of flow of the gaseous atmosphere, preferably in the direction opposite to the direction of rotation of the hearth 66. This counterflow of the gases as they travel from the outlet of one fan assembly to the inlet of the next fan assembly (without, however, "hugging" the outer sidewall 76) promotes thorough mixing of the gases within the carburizing furnace chamber 69 and ensures good contact between the parts and fresh, carbon-enriched gaseous atmosphere.

When the carburization of a tray of parts in the furnace 30 nears completion, the hearth 66 is rotated to place the tray in the discharge position 94. The doors 124 in the connecting zone 126 between the carburizing furnace 30 and the diffusion furnace 32 are then opened and the tray of parts is pushed into a preselected position in the annular furnace chamber 128 of rotary diffusion furnace 32 by a motor-driven captive chain pusher 130 which interacts with a suitable tray positioner 131 within the central donut hole 133 of the diffusion furnace 32. Because the carburizing furnace 30 is constructed in the shape of a donut, its central "hole" 132 permits the location and operation of the pusher 130 within this open space. This avoids the need for puller mechanisms within the hot connecting zone or throat 126 between furnaces 30 and 32. The donut shape also facilitates zoning of the furnace 30, as described earlier, for improved temperature control throughout the annular furnace chamber 69.

It is preferred that the doors 124 between furnaces 30 and 32 be of the double-door type similar to the previously described double doors 61 between the preheater 22 and the carburizer 30. This double-door arrangement prevents intermixing of the different gaseous atmospheres of the furnaces 30 and 32, particularly when the doors 124 are opened for transport of parts into the diffusion furnace 32.

The rotary diffusion furnace 32 and the rotary equalizer furnace 34 are similar in structure to the carburizing furnace 30 but normally have smaller chambers than the furnace 30—e.g., they may have eight tray positions as compared to the fourteen which may be provided in the carburizing furnace 30. This is possible since part residence times in the furnaces 32 and 34 are substantially shorter than those in the carburizer 30 and hence fewer tray positions are required to process the same number of parts as are treated in the carburizing furnace 30. Of course, any or all of the rotary furnaces 30, 32 and 34 may operate at less than full capacity, and it may be desirable to leave tray positions empty to separate trays containing different types of parts.

Figure 3:
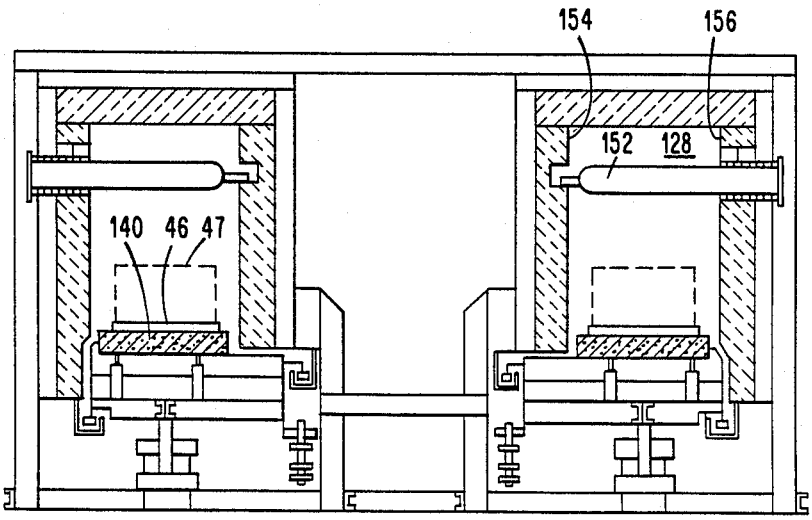
FIG. 3 is an elevational view in section of the rotary diffusion furnace taken along the line 3—3 of FIG. 1.

The diffusion furnace 32 includes a rotatable hearth 140 and two zones of temperature control 144, with each zone being provided with a temperature sensor 146 and a roof-mounted fan 148 to maintain uniform gaseous atmosphere. In a preferred furnace system 20 illustrated in FIG. 1, the furnace chamber 128 of the rotary diffusion furnace 32 includes two zones 144 each equipped with a single roof fan 148 of the radial-flow type. The diffusion furnace 32 functions to adjust the carbon content in the outer layers of the parts, typically producing a uniform level of carbon from the surface of the parts to a predetermined depth. To accomplish this, a gaseous atmosphere of somewhat lower carbon content than utilized in the carburizer 30 (e.g., 0.9 percent) is provided in the diffusion furnace 32 by an endothermic gas generator to whose output a carbon enriching gas is added. The desired carbon level is maintained by means of a suitable atmosphere analyzer/controller which may include oxygen probes. Radiant tubes 152 (FIG. 3) extend between inner and outer sidewalls 154 and 156 to maintain a selected diffusion temperature such as 1700° F.

The diffusion furnace 32, like the carburizer 30, permits part requiring different diffusion times to be processed together at the same time in the diffusion furnace chamber 128 since its hearth 140 can, upon demand, move a tray of parts from any position within the furnace 32 to the point of discharge. Thus, after selected parts have been heat-treated in the diffusion furnace 32 for their specific time, the hearth 140 is rotated to move the tray containing the parts to a discharge position 158 aligned with a doorway leading into the equalizing furnace 34 and also aligned with a motor-driven captive chain type pusher 162 positioned within the central hole 133 defined by the donut-shaped diffusion furnace 32. Double doors 168, which are similar to the double doors 124 between the carburizer 30 and the diffusion furnace 32, are then opened and the tray is pushed into the equalizer 34.

The equalizer 34 is similar in structure to the rotary furnaces 30 and 32 and includes (FIG. 3) a rotatable hearth 170, radiant tubes 172, and means (not shown) for maintaining a controlled carbon-enriched (e.g., 0.9 percent) gaseous atmosphere in its furnace chamber 174. One or more fans 176 of the radial-flow type extend through the roof 180 to help maintain uniformity of the gaseous atmosphere of the equalizer furnace chamber 174, and the equalizing furnace includes two zones of temperature control with each zone being provided with a temperature sensor 178. Also, the equalizing furnace 34 includes three outlets 186, 187, and 188 to permit different quench and cooling treatments to be utilized as required. The equalizer 34 thus serves as a transport device having considerable flexibility in moving parts to different quenching stations. It also functions to lower the temperature of parts from their diffusion temperature to a specified level (such as about 1540° F.) prior to quenching, and to reheat parts reintroduced into the equalizer 34 from a slow cool chamber 202 adjacent to the outlet 187.

As is illustrated in FIG. 1, the central opening 189 formed by the donut-shaped equalizing furnace 34 accommmodates three motor-driven captive chain type pushers 190, 191, and 192 aligned, respectively, with the three outlets 186, 187, and 188 of the equalizer 34. Two tray positioners 193 and 194 are also located within the hole 189 to help in correctly positioning trays being pushed into the equalizer chamber 174 from the rotary diffusion furnace 32 or returned from the slow cool chamber 202 aligned with the outlet 187 of the equalizer 34.

Figure 4:
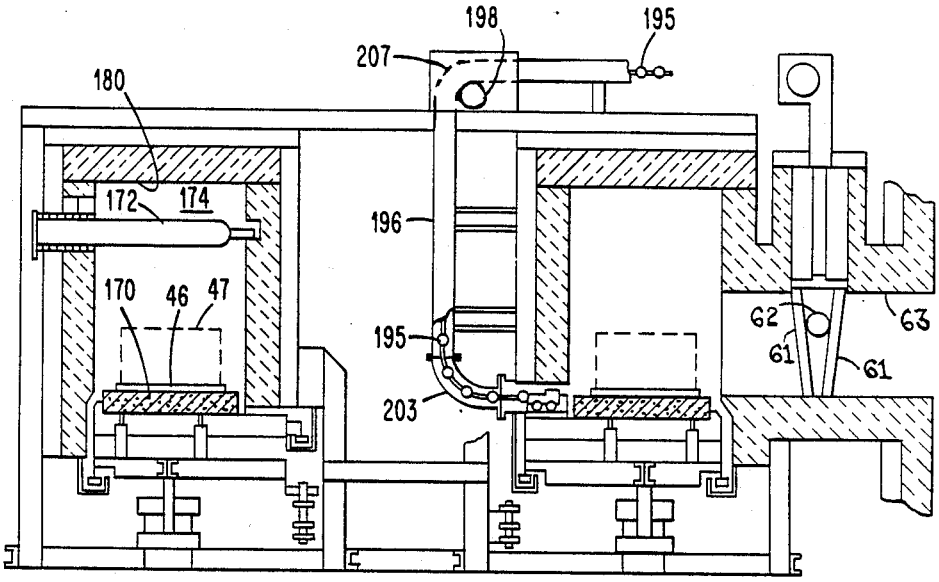
FIG. 4 is an elevational view in section of the rotary equalizing furnace taken along the line 4—4 of FIG. 1.

To minimize the size of the donut opening or hole 189, the pushers 190, 191, and 192 preferably are mounted such that portions of their chain holding tubes 196 and the sprockets 198 which drive their "stiff" chains 195 are vertically-oriented (see FIG. 4) rather than being mounted in horizontal fashion as are the captive chain pushers 48 and 65 associated with the preheat furnace 22. Thus a the sprockets 198 of the pushers 190, 191, and 192 are driven, as by roof-mounted motors, the chains 195 move horizontally into and out of the equalizer furnace chamber 174, along 90-degree bends 203 and 207, and both vertically and horizontally within their holders 196. The pushers 130 and 162 of the rotary furnaces 30 and 32 are also mounted in vertical fashion.

As is also shown in FIG. 1, one outlet 186 of the equalizer 34 is separated by a door 199 from an elevator dunk quench apparatus 200, a conventional device including an elevator which lowers parts into a tank containing a quench medium such as oil and thereafter raises them for further post-quench processing. Parts rotated to the outlet position 186 of the equalizer 34 are moved by the motor-driven captive chain type pusher 190 onto the elevator of the dunk quench apparatus 200. The parts are lowered and dunk-quenched, then raised and moved to a post-quench transport line 201

For parts to be slow-cooled—e.g., to a temperature of about 700°-800° F.—the hearth 170 of the equalizer 34 is rotated to a position adjacent to the outlet 187 in front of the two-position slow-cool chamber 202. A single connecting inner type door 204 is raised and a tray is moved by the motor-driven captive chain type pusher 191 to one of the two tray positions in the slow-cool chamber 202. The tray is then raised by a lift mechanism into a slow-cool position, and cooling may be provided by water-cooled plates surrounding the external upper portion of the slow cool chamber and by a gaseous atmosphere circulated by two roof-mounted axial flow fans 205. Two tray positions are provided so that a tray in either the "front" or "back" position can at any time be lowered and moved by a pusher 206 back into the equalizer 34 for reheating followed by either quenching or another slow-cool cycle. Trays can also be transferred directly from the slow-cool chamber 202 to a tray return line 210 by action of a captive chain type pusher 208 which removes a tray from the back position of the chamber 202. Either of the two trays being slow-cooled can be removed in this manner.

Parts returned to the equalizing furnace 34 are reheated in the equalizer furnace chamber 174, and then quenched either in the dunk quench 200 or in press quenches 212 which are loaded manually with parts removed from a press quench holding chamber 214. The chamber 214 is connected to the equalizer 34 adjacent to the outlet 188 and is supplied with parts by opening of the door 216 and action of the motor-driven captive chain type pusher 192. The press quenches 212, which include fixtures or dies to hold parts tightly while a quench medium is applied, are utilized to quench parts too distortion-prone to be processed in the dunk quench 200.

The press quench holding chamber 214 preferably has radiant tubes extending across it above a hearth for maintaining temperature of parts to a selected level such as about 1540° F. and is supplied with a carbon-enriched gaseous atmosphere of carbon content equal to or slightly below that of the equalizing furnace 34. The chamber 214 may have two tray positions for holding trays containing different types of parts—e.g., one position 218 for stacked gears and a second position 220 for shafts. The position 218 is accessed through a vertical moving wall and a slot-type door 222, and the position 220 is accessed through a saloon-type, vertically hinged door 224. The different door arrangements give good access to the particular parts while minimizing infiltration of air into the press quench holding chamber 214 during repetitive opening of the doors 222 and 224.

After being quenched, parts are transported through other conventional components of the furnace system 20 for post-quench processing. Parts which have been press-quenched are reloaded onto trays which have been cooled by action of a small fan 230 mounted at a quench tray cool station 232 and are then moved along the transport line 201 by suitable transport mechanisms such as dog rail transporters.

As illustrated in FIG. 1, quenched parts are passed, in the order in which they arrive at a post-quench position 234, through wash (and optional rinse) tank(s) 236 and then (optionally) through a tempering furnace 24. The furnace 24 may be an electrically-heated or gas-fired furnace of rectangular cross-section wherein parts are reheated, for example to a temperature of about 300° F., to relieve stresses and to decrease hardness and increase ductility. If necessary, parts are manually straightened at a station 240 near the outlet 242 of the tempering furnace 24. An electrically heated chamber 244 with a manually operated part removal door may be provided to keep parts hot (e.g., at about 300° F.) prior to straightening. An additional operation which may be performed during transport of the parts to the load/unload area 38 include removal of parts from the fixtures in which they are held. A tray turnover station 246 is used to minimize tray warping. Cleaning of parts may be performed in a shot blast station (not shown).

The entire furnace system 20 is controlled by a computerized control center 250 which includes menus and stored commands for controlling the various doors, pushers, and the rotatable hearths of the various furnaces included in the system, and for presetting furnace temperatures and atmosphere carbon contents. The control center 250 is also connected to encoders linked to the drive mechanisms 92 of each rotary furnace so as to keep track of the position and processing conditions of each tray of parts within each of the rotary furnaces. The continual tracking of parts allows immediate determination of the location of each tray within the furnace system in the event of a shutdown and also permits processing histories to be accumulated for each part which facilitates quality control.

The rotary furnaces 30, 32, and 34 of the furnace system 20 are sized to readily fit pusher structures and tray positioners within the central opening or hole of their donut shape and to allow access to the central opening for maintenance and to provide furnace chambers of a size adequate for trays to be processed and for maintenance of the furnace. Each of the rotary furnaces of the present invention may, for example, have a minimum diameter of the central opening of about five feet, and a total diameter of up to about thirty feet, although, as mentioned above, the diffusion furnace 32 and the equalizing furnace 34 preferably have outer diameters somewhat smaller than that of the carburizing furnace. A typical tray size may be about 30 inches square , and typical rotational speeds of the hearths of the rotary furnaces during production are about one revolution per minute. This relatively high speed renders two-directional hearth rotation unnecessary during production and helps assure uniform heat treatment of the parts. During a processing cycle parts may remain in the carburizing furnace 30 for about 7-15 hours, and in the diffusion furnace 32 and the equalizing furnace 34 for about 1½-4 hours each, depending on the type of part being heat-treated and the effective and diffused case depths desired.

Figure 9:
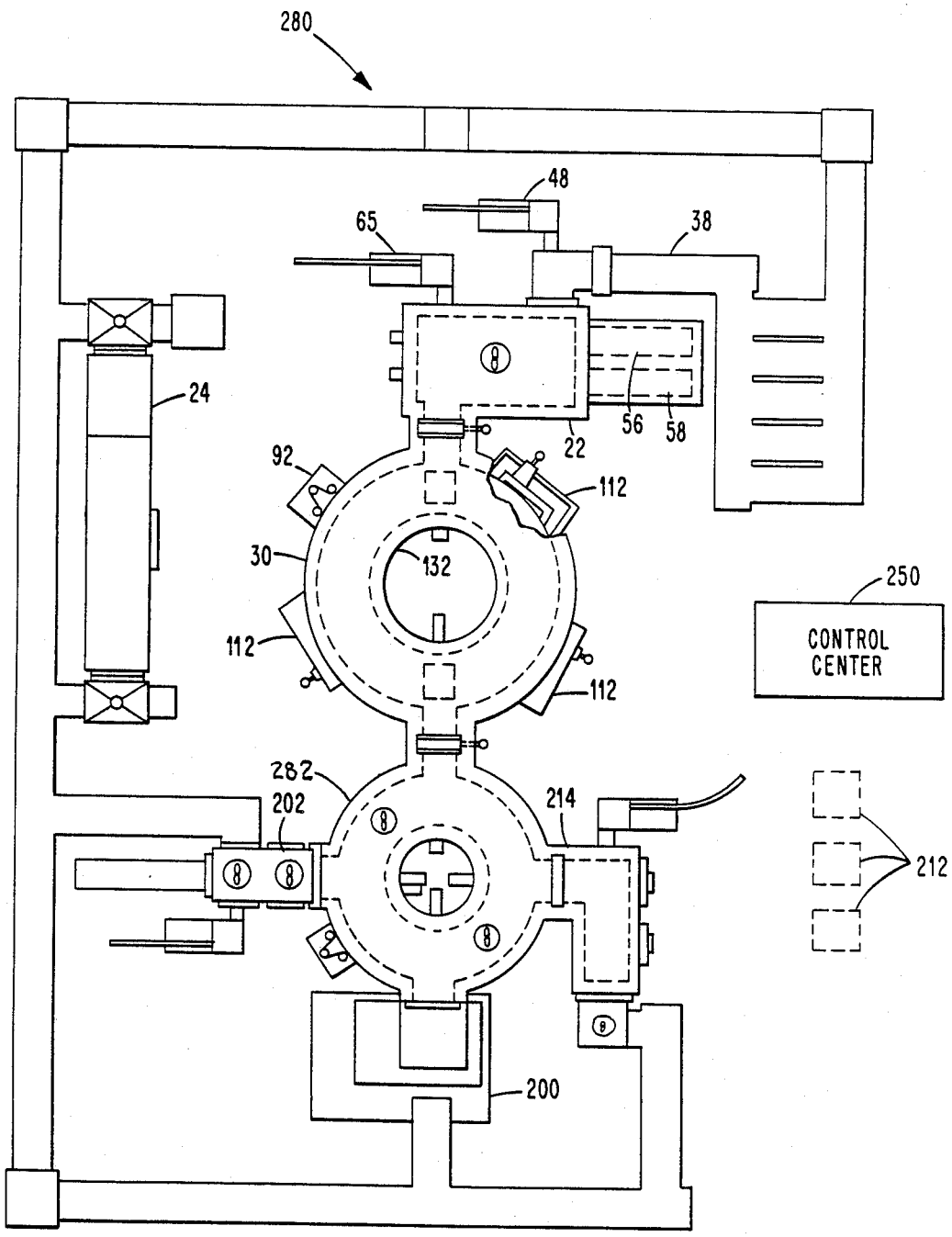
FIG. 9 is a diagrammatic view of a furnace system according to an alternate embodiment of the invention.

FIG. 9 is a plan view of an alternate embodiment of the invention, with furnaces and other portions of its system labeled with the same numbers as are used for corresponding elements of the above-described furnace system 20. The furnace system 280 illustrated in FIG. 9 differs from the system of FIG. 20 in that it does not include a separate diffusion furnace, both diffusion and equalizing treatments occurring instead in a single rotary furnace 282. Parts not requiring diffusion in a furnace separate from the diffuser/equalizer 282 can readily be processed in the dual-rotary system 280 in less total time and at lower cost than in the earlier-described system 20, yet with all the other advantages and flexibility of the tri-rotary furnace system.

The furnace systems disclosed in this detailed description and illustrated in the drawing are preferred embodiments, and changes may be made therein without departing from the spirit or scope of the invention.

The invention is defined as all embodiments and their equivalents within the scope of the claims which follow.

What is claimed is:

1. A furnace system for heat-treating pars comprising:

a preheat furnace having an inlet for receiving parts, an outlet for discharging parts, wall means for defining a preheat furnace chamber, and means for providing a gaseous, non-scaling atmosphere to said preheat furnace chamber;

a rotary carburizing furnace connected to, and adapted to receive parts from, said preheat furnace, said carburizing furnace including a generally circular, rotatable hearth for supporting trays of parts, insulated inner and outer walls and a roof enclosing said hearth and forming an annular carburizing chamber, said outer wall having an inlet and an outlet therein and said inner wall defining a generally circular space radially inward thereof, means for providing a gaseous carburizing atmosphere to said carburizing chamber, means for maintaining said carburizing atmosphere at a selected temperature and carbon content, and means for rotating said hearth about said circular space;

a first pair of interconnecting doors between the outlet of said preheat furnace and the inlet of said carburizing furnace;

a preheat pusher operable to push a tray of parts through the outlet of said preheat furnace and into said carburizing chamber when said first pair of doors is open;

a rotary diffusion furnace connected to, and adapted to receive parts from, said carburizing furnace, said diffusion furnace including a generally circular, rotatable hearth for supporting trays of parts, insulated inner and outer walls and a roof enclosing said hearth and forming an annular diffusion chamber, said outer wall having an inlet and an outlet therein and said inner wall defining a generally circular space radially inward thereof, means for providing a controlled gaseous diffusion atmosphere to said diffusion chamber, means for maintaining said diffusion atmosphere at a selected temperature and carbon content, and means for rotating said hearth about said ciruclar space;

a second pair of interconnecting doors between the outlet of said carburizing furnace and the inlet of said diffusion furnace;

a carburizer pusher positioned within the circular space defined by the inner wall of said carburizing furnace and operable to push a tray of parts from said carburizing chamber to said diffusion chamber when said second pair of interconnecting doors is open;

a rotary equalizer connected to, and adapted to receive parts form, said diffusion furnace, said equalizer including a generally circular, rotatable hearth for supporting trays of parts, insulated inner and outer walls and a roof enclosing said hearth and forming an annular equalizing chamber, said outer wall defining a generally circular space radially inward thereof, means for providing a controlled gaseous equalizing atmosphere to said equallizing chamber, means for maintaining said equalizing atmosphere at a selected carbon content and a selected temperature below the temperature of said diffusion atmosphere, and means for rotating said hearth of the equalizer about said circular space;

a third pair of interconnecting doors between the outlet of said diffusion furnace and the inlet of said equalizer;

a diffusion pusher positioned within the circular space defined by the inner wall of said diffusion furnace and operable to push a tray of parts from said diffusion chamber to said equalizing chamber when said third pair of interconnecting doors is open;

quench apparatus connected to, and operable to receive parts from, said equalizer;

a door between the outlet of said equalizer and said quench apparatus and through which, when said door is open, trays of parts may be pushed from said equalizer to said quench apparatus; and an equalizer pusher positioned within the circular space defined by the inner wall of said equalizer and operable to push a tray of parts from said equalizing chamber into said quench apparatus, said equalizer pusher including a chain, sprocket means for engaging said chain and moving the chain upon being driven, a motor for driving said sprocket means, and a chain holder having a generally vertical portion adjacent to the inner wall of said equalizer and a curved portion shaped to change the direction of travel of said chain from vertical to horizontal.

2. A furnance system as in claim 1 wherein the motor for driving said sprocket means of said equalizer pusher is mounted on the roof of said equalizer.

3. A furnace system as in claim 1 wherein said outer wall of said equlaizer includes first and second outlets and said quench apparatus comprises a press quench holding assembly connected to said equalizer adjacent to said first outlet and a dunk quench assembly connected to said equalizer adjacent to said second outlet, said equalizer including first and second equalizer pushers positioned within the circular space defined by the inner wall of said equalizer and operable to push trays of parts from said equalizing chamber into, respectively, said press quench holding assembly and said dunk quench assembly, a first door between said first outlet of the equalizer and said press quench holding assembly, and a second door between said second outlet of the equalizer and said dunk quench assembly, each of said equalizer pushers being a captive chain type pusher including a chain, sprocket means for engaging said chain and moving the chain upon being driven, a motor for driving said sprocket means, and a chain holder having a generally vertical portion position adjacent to said inner wall of said equalizer and a curved portion shaped to change the direction of travel of said chain from vertical to horizontal for movement of a pusher end of said chain into and out of an outlet of said equalizer.

4. A furnace system as in claim 3 wherein said outer wall of said equalizer includes a third outlet, and said furnace system further includes a slow cool assembly connected to said equalizer and defining a slow cool chamber, a door between said third outlet of the equalizer and said slow cool assembly, and a third equalizer pusher positioned within the circular space defined by the inner wall of said equalizer and operable to push trays of parts from said equalizer and operable to push trays of parts from said equalizing chamber to said cool chamber when said door between said third outlet and said slow cool assembly is open, said third equalizer pusher including a chain, sprocket means for engaging said chain and moving the chain upon being driven, a motor for driving said sprocket means, and a chain holder having a generally vertical portion positioned adjacent to the inner wall of said equalizer and a curved portion shaped to change the direction of travel of said chain from vertical to horizontal.

5. A furnace system as in claim 1 wherein said annular carburizing chamber includes at least three zones each of substantially equal size, and said means for maintaining said carburizing atmosphere at a selected temperature and carbon content includes means for maintaining a uniform carburizing atmosphere in each of said zones comprising:

a temperature sensor positioned near the center of each zone and a sufficient distance above the hearth of said carburizing furnace as not to interfere with the movement of loaded trays thereunder;

at least one radiant tube in each zone extending between the inner and outger walls of said rotary carburizing furnace and operable in response to temperatures monitored by said temperature sensor to provide heat to said zone to maintain a selected temperature; and a sidewall fan, said fan mounted in a tunnel formed in the outer wall of said rotary carburizing furnace and adapted to circulate the gaseous carburizing atmosphere about said carburizing chamber in a genrally circumfernetial direction opposite to the direction of rotation of the hearth of said carburizing furnace.

6. A furnace system as in claim 1 includcing gas barrier means in the space betwene the doors of said first pair of interconnecting doors for preventing entry of said carburizing atmosphere into said preheat furnace and entry of said preheat atmosphere into said carburizing furnace.

7. A furnace system as in claim 1 including gas barrier means in the space defined between the doors of said second pair of interconnecting doors for preventing entry of said carburizing atmosphere into said diffusion furnace and entry of said diffusion atmosphere into said carburizing furnace.

8. A furnace system as in claim 1 including gas barrier means in the space defined between the doors of said third pair of interconnecting doors for preventing entry of said diffusion atmosphere into said equalizer and entry of said equalizing atmosphere into said diffusion furnace.

9. A furnace system as in claim 1 wherein said rotary carburizing furnace includes at least three zones, each of substantially equal size, and means for controlling the temperature and carbon content of said carburizing atmosphere in each of said zones.

10. A furnace system as in claim 1 wherein said diffusion pusher is a captive chain type pusher including a chain, sprocket means for engaging said chain and moving the chain upon being driven, a motor for driving said sprocket means, and a chain holder positioned adjacent to said inner wall of said furnace, said chain holder having a generally vertical portion and a curved portion shaped to change the direction of travel of said chain from vertical to horizontal for movement of a pusher end of said chain into and out of said diffusion chamber.

11. A furnace system as in claim 4 wherein each of said pushers within the circular spaceds of said rotary furnaces includes a chain, sprocket means for engaging said chain and moving the chain upon being driven, a motor for driving said sprocket means, and a chain holder having a generally vetical portion positioned adjacent to the inner wall of said furnace and a curved portion shaped to change the direction of travel of said cahin from vertical to horizontal.

12. A furnace system as in claim 1 wherein the circular spaces defined by the inner walls of said carburizing furnace, said diffusion furnace, and said equalizer have a diameter of at least about five feet.

13. A furnace system as in claim 1 wherein each of said means for rotating said hearths of said carburizing furnace, diffusion furnace, and equalizer is operable to rotate said hearth at a speed of at least one revolution per minute.

14. A furnace system for heat-treating parts comprising:

a preheat furnace having an inlet for receiving parts, an outlet for discharging parts, and means for providing a gaseous, non-scaling atmosphere to said preheat furnace;

a rotary carburizing furnace connected to, and adapted to receive parts from, said preheat furnace, said caruburizing furnace including a generally circular, rotatable hearth for supporting trays of parts, inslulated inner and outer walls and a roof enclosing said hearth and forming an annular carburizing chamber, said outer wall having an inlet and an outlet therein and said inner wall defining a generally circular space radially inward thereof, means for providing a gaseous carburizing atmosphere to said carburizing chamber means for maintaining said carburizing atmosphere at a selected temperature and carbon content, and means for rotating said hearth about said circular space;

a first pair of interconnecting doors between the outlet of said preheat furnace and the inlet of said carburizing furnace;

gas barrier means in the space between said first pair of interconnecting doors for preventing intermixing of said carburizing atmosphere and said preheat atmosphere;

a preheat pusher operable to push a tray of parts through the outlet of said preheat furnace and into said carburizing chamber when said first pair of doors is open;

a rotary diffuser/equalizer connected to, and adapted to receive parts from, said carburizing furnace, said diffuser/equalizer including a generally circular, rotatable hearth for supporting trays of parts, insulated inner and outer walls and a roof enclosing said hearth nd forming an annular diffusion/equalizing chamber, said outer wall having an inlet and first, second, and third outlets therein and said inner wall defining a generally circular space radially inward thereof, means for providing a controlled gaseous diffusion/equalizing atmosphere to said diffusion/equalizing chamber, means for maintaining said diffusion/equalizing atmosphere at a selected temperature and carbon content, and means for rotating said hearth of the diffuser/equalizer about said circular space;

a second pair of interconnecting doors between the outlet of said carburizing furnace and the inlet of said diffuser/equalizer;

gas barrier means in the space between said second pair of interconnecting doors for preventing intermixing of said carburizing atmosphere and said diffusion atmosphere;

a carburizer pusher positioned within the circular space defined by the inner wall of said carburizing furnace and operable to push a tray of parts from said carburizing chamber to said diffusion/equalizing chamber when said second pair of interconnecting doors is open;

first and second quench apparatuses connected to, and operable to receive parts from, said diffuser/equalizer through said first and second outlets, respectively;

a slow cool assembly connected to, and defining a slow cool chamber operable to receive parts from and deliver parts to, said equalizer/pusher through said third outlet;

a door between each outlet of said diffuser/equalizer and said quench apparatuses and said slow cool assembly; and first, second and third diffuser/equalizer pushers positioned within the circular space defined by the inner wall of said diffuser/equalizer and operable, respectively, to push a tray of parts from said diffusion/equalizing chamber into said first quench apparatus, said second quench apparatus, and said slow cool assembly.

15. A furnace system as in claim 14 wherein each of said diffuser/equlizer pushers includes a chain, sprocket means for engaging said chain and moving the chain upon being driven, a motor mounted on the roof of said diffuser/equalizer for driving the sprocket means, and a chain holder having a generally vertical portion positioned adjacent to the inner wall of said diffuser/equalizer, and a curved portion shaped to change the direction of travel of said chain from vertical to horizontal.

16. A furnace system as in claim 14 further including a pusher adjacent to one end of said slow cool assembly and operable to return trays of parts from said slow cool chamber to said diffusion/equalizing chamber for reheating of said parts.

* * * * *